United States Patent [19]

Zanuso et al.

[11] Patent Number: 4,642,821

[45] Date of Patent: Feb. 17, 1987

[54] SELF-CLEANING SANITARY APPARATUS

[75] Inventors: Marco Zanuso; Fabio Fratti, both of Milan, Italy

[73] Assignee: I.C.A. S.p.A. Industria Componenti per l'Architettura, Pomezia, Italy

[21] Appl. No.: 840,338

[22] Filed: Mar. 17, 1986

[30] Foreign Application Priority Data

Jun. 28, 1982 [IT] Italy .....22105 A/82

Related U.S. Application Data

[63] Continuation-in-part of Ser. No. 506,483, Jun. 21, 1983, abandoned.

[51] Int. Cl.[4] ..... A47K 4/00; E03C 1/01

[52] U.S. Cl. ..... 4/662; 4/460

[58] Field of Search ..... 4/111.6, 313, 300, 314, 4/234, 237, 302–305, 308, DIG. 15, 460, 662, 643, 644; 52/34, 249

[56] References Cited

U.S. PATENT DOCUMENTS 2,220,482 11/1940 Fuller ..... 52/34

4,295,233 10/1981 Hinkel et al. ..... 4/643 X

*Primary Examiner*—Charles E. Phillips

*Attorney, Agent, or Firm*—Guido Modiano; Albert Josif

[57] ABSTRACT

The invention relates to a self-cleaning sanitary apparatus which comprises a booth provided with an automatically openable door and formed by an outer shell having an inner shell off-centered therein, thereby between the two shells a space is defined which accommodates devices for effecting the functions of the apparatus. The cited devices comprise an automatic dispenser of toilet paper, a hand washing compartment for the user, equipped with an automatic soap dispenser, and a plurality of flushing liquid dispensing nozzles arranged peripherally over the inner wall of the inner shell. The inner shell interior includes a bowl seat and a tilting footrest acting as a floor, which is connected to weight sensing members for a person, in turn connected kinematically to members controlling the cabin door opening and closing to only enable its use by a single person.

15 Claims, 14 Drawing Figures

1
3
15
7
6

SELF-CLEANING SANITARY APPARATUS

This is a continuation-in-part application of Ser. No. 06/506,483 filed on 6.21.1983 now abandoned.

BACKGROUND OF THE INVENTION

The invention relates to a self-cleaning sanitary apparatus.

As is known, long available commercially have been self-cleaning sanitary apparatus mostly utilized in public washrooms, which are based on the concept of providing automatic cleaning devices which are operated, in a predeterminated cycle, by the introduction of a coin, or anyhow, by the user entering the apparatus compartment.

Such prior apparatus are in general not very effective, since the arrangement and construction of the various automatic cleaning devices fail to entirely achieve their objective.

Furthermore, the cited apparatus are currently implemented to suit criteria which practically afford no safeguard from vandalic acts, they usually having several elements jutting out of the walls which, besides being difficult to clean, are more likely to invite vandalic acts.

Another disadvantage of currently known apparatus is that they are generally quite bulky, which makes their adaptation to the city environment for which the apparatus of this invention is intended no easy accomplishment.

SUMMARY OF THE INVENTION

It is the aim of this invention to provide a self-cleaning sanitary apparatus which is so designed as to present no elements in actual practice which may suffer damage from vandalic acts, and is highly safe to use and safeguarded against improper use thereof.

Within the above aim, it is a particular object of this invention to provide a self-cleaning sanitary apparatus which, by virtue of a rational layout of its component parts, can be subjected to a highly effective cleaning action throughout, and especially over those areas which are bound to be contacted by the user one way or another.

A further object of this invention is to provide a self-cleaning sanitary apparatus which, on account of its peculiar constructional features, can give full assurance of being reliable and safe to use, as well as hygienic.

A not least important object of this invention is to provide a self-cleaning sanitary apparatus which is configured as a combination of modules which can be readily installed and inspected.

The above aim, as well as these and other objects to become apparent hereinafter, are achieved by a self-cleaning sanitary apparatus, according to the invention, which comprises: a booth having an automatically openable arcuate door, a tubular outer shell including a number of arcuate panels defining a tubular outer wall, a tubular inner shell at least vertically surrounded by said outer shell, said tubular inner shell defining within said booth a tubular inner wall of a smaller diameter than said tubular outer shell, said inner shell being positioned off-center with respect to said outer shell to define a space between said inner and outer shells having a region of maximum breadth and a region of minimum breadth, said door being located in said region of minimum breadth, a bowl seat housed within said inner shell, a tilting footrest defining the floor of said inner shell and having a center portion of larger height than its peripheral portion, members for sensing a person in said inner shell and connected to said tilting footrest and to actuator members for said door, an automatic toilet paper dispenser housed in said space for dispensing a metered amount of said toilet paper inside said inner shell, a hand washing compartment housed in said space and including an automatic soap dispenser, a plurality of washing liquid dispensing nozzles arranged peripherally around said inner wall to form a layer of said liquid exhibiting laminar flow over the lower portion of said inner wall, directed nozzles dispensing water at differentiated pressures and housed in said bowl seat, members for flushing said bowl seat housed in said space and comprising a flushing hood having such a conformation as to overlap said bowl seat, a fan associated rotatably with the hood face confronting said bowl seat, said fan having in its end portions respectively a first opening for dispensing said liquid over said bowl seat surfaces affected by the user along an angled direction to the rotation plane of said fan and a second opening for dispensing said liquid along an orthogonal direction to said rotation plane, a motor driving said fan, a cogged belt for transmitting the motion from a first pulley rigidly associated with said motor to a second pulley rigidly associated with said fan and having a larger diameter than said first pulley, a ventilating cowl associated with said hood on the motor side thereof next to said first and second pulleys and remote from said fan, hood control members for swinging it through an opening in said inner wall from said space inwardly of said inner shell and vice versa.

BRIEF DESCRIPTION OF THE DRAWINGS

Further features and advantages of the invention will be more clearly apparent from the following description of a preferred but not exclusive embodiment of this self-cleaning sanitary apparatus, with reference to the accompanying illustrative drawings, where.

DESCRIPTION OF THE PREFERRED EMBODIMENT

Figure 1:
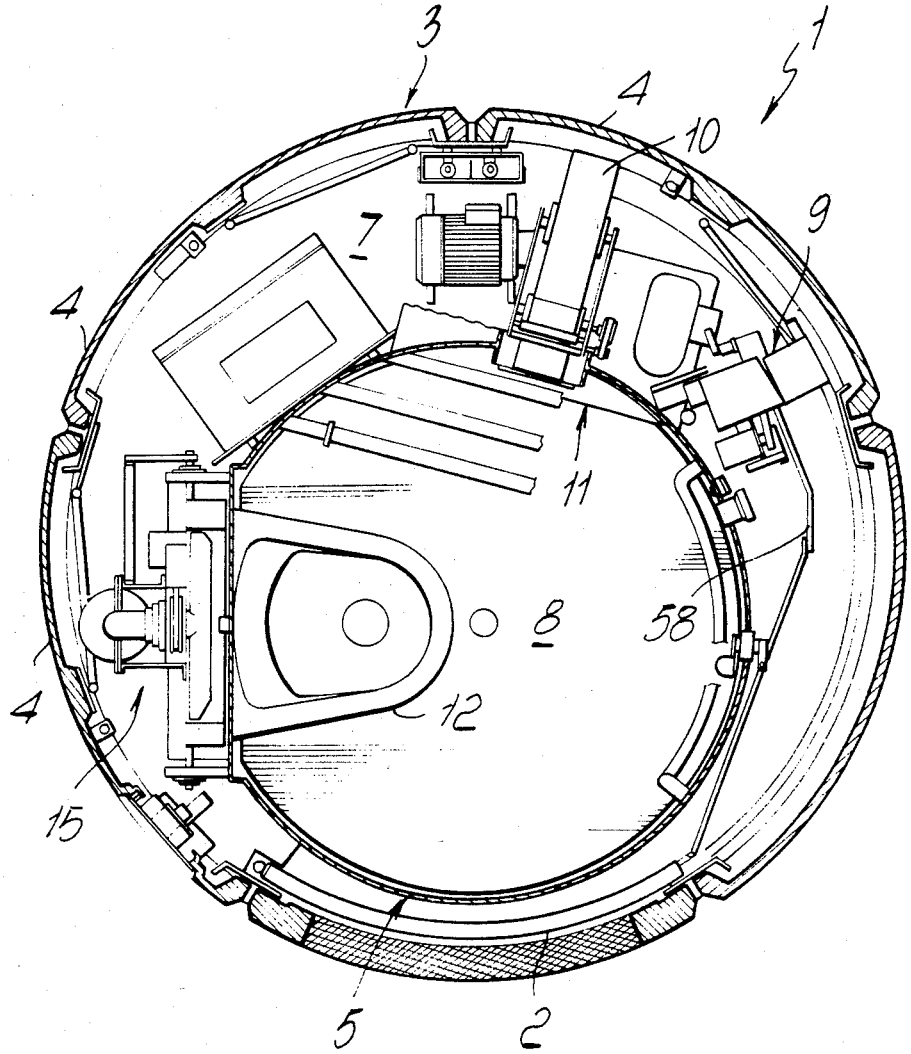
FIG. 1 shows a cross-sectional plan view of the apparatus.
Figure 2:
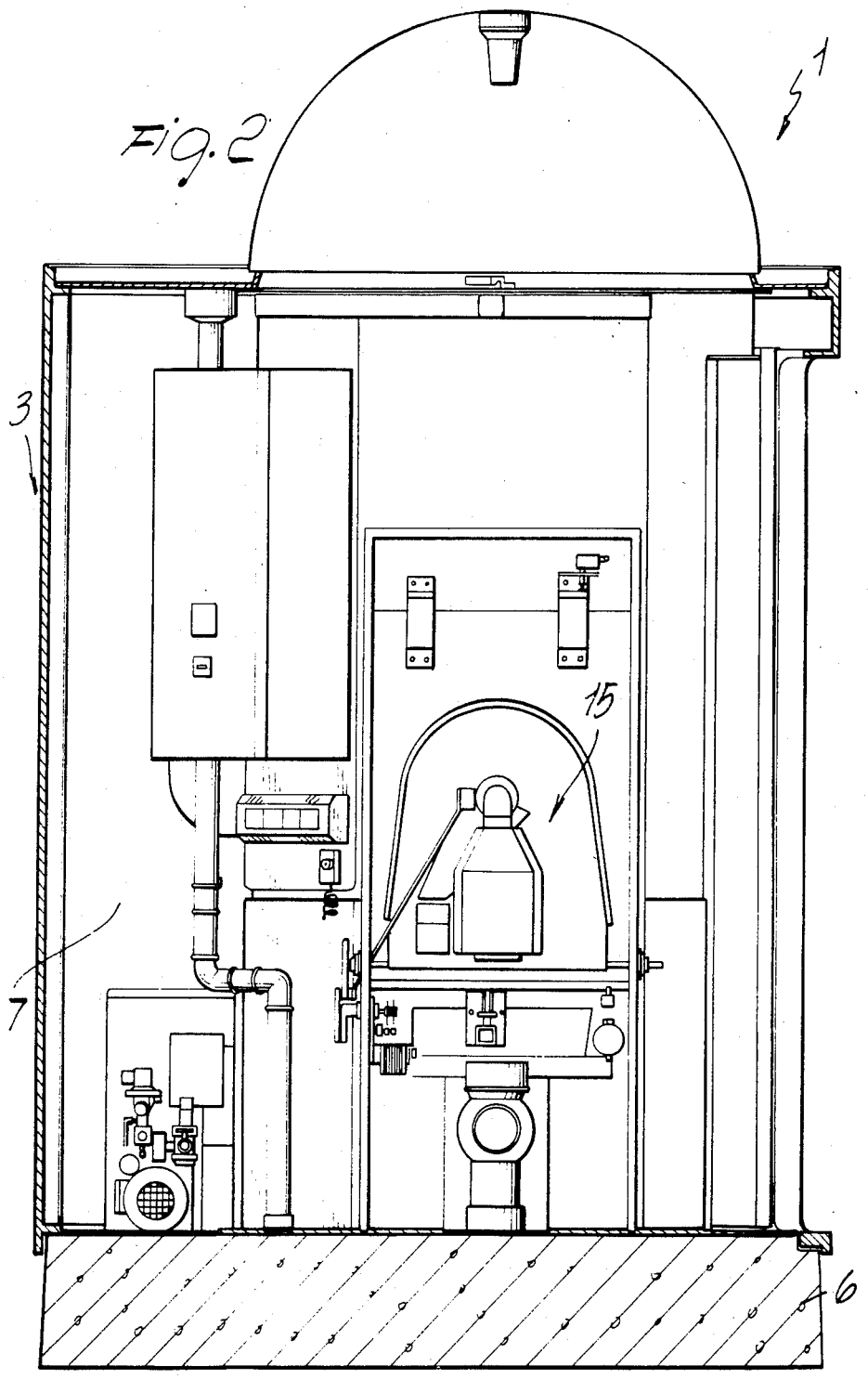
FIG. 2 is a cut-away side elevation view of FIG. 1.
Figure 3:
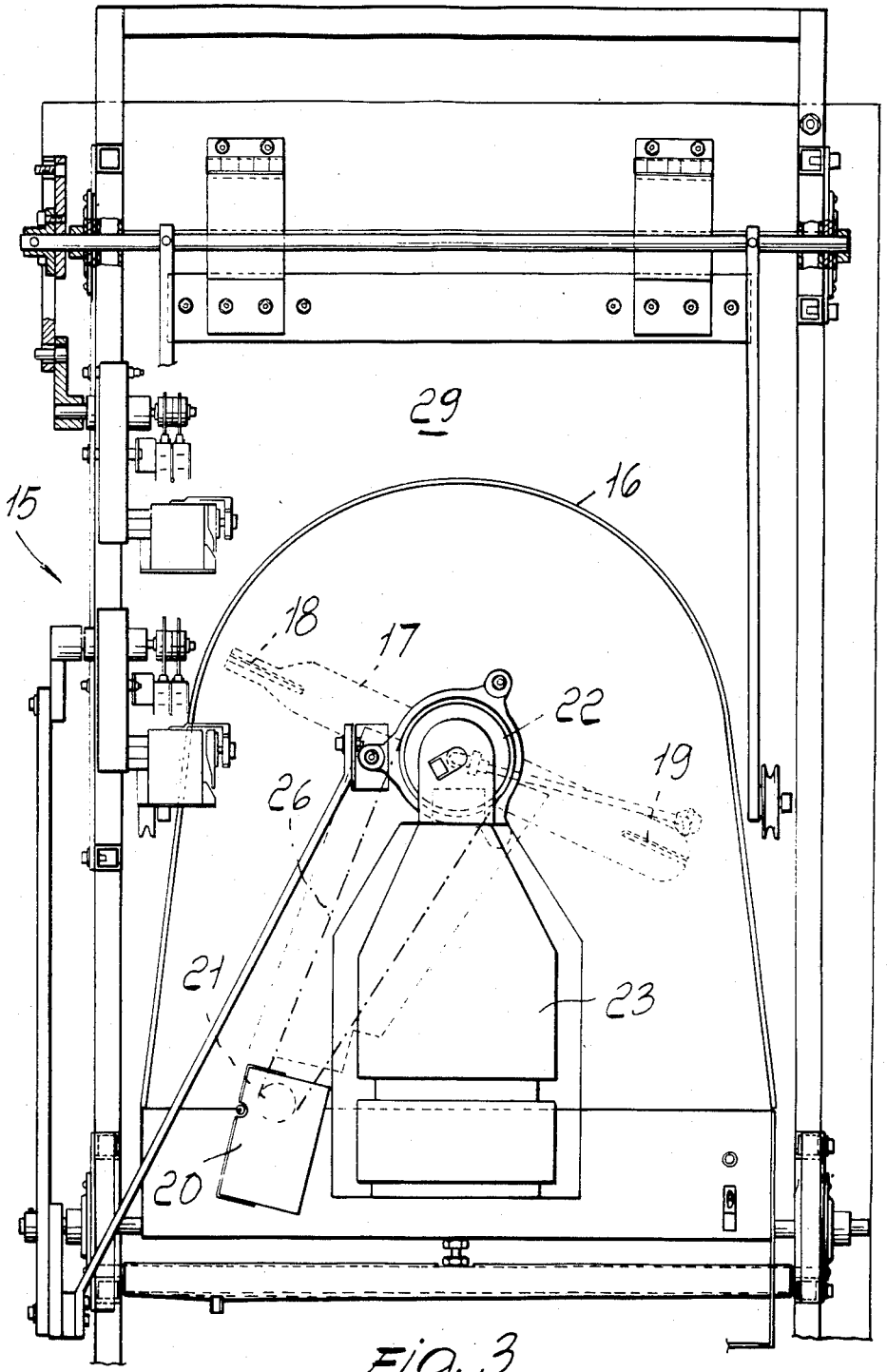
FIG. 3 is a rear elevation view of the bowl seat flushing members according to the invention.

With reference to the cited drawing figures, a self-cleaning sanitary apparatus according to the invention comprises a cabin or booth, generally designated by the reference numeral 1, which has, as shown in the drawings, a substantially cylindrical conformation.

The cabin 1 is provided with automatically openable door 2 of arcuate conformation, as explained herein below. The cabin construction includes an outer shell 3 of tubular conformation which is composed of a number of panels, each indicated at 4 and having an arcuate conformation to define a tubular outer wall of the cabin 1.

Provided inside the outer shell 3 is an inner shell 5 resting, like the outer shell 3, on a bed 6 and being arranged on the latter off-center with respect to the outer sheel, thereby defining a space, generally designated 7, having a region of maximum breadth and a region of minimum breadth in the vicinity whereof is the automatically openable door 2.

The floor of the inner shell is defined by a tilting footrest 8 having a middle portion at a higher level than its peripheral portion to favor draining away the flushings liquids during the inner shell 5 interior cleaning operation.

In the space 7, there are provided members for sensing the weight of a person present on the tilting footrest, collectively designated 9, which are connected to actuator members for the door 2 and to the footrest 8 itself.

Also present in the space 7 are an automatic toilet paper dispenser, indicated at 10, which is adapted to dispense a metered amount of such paper to the interior of the inner shell for access by the user, laterally of the toilet paper dispenser there being, again within the space, an automatic soap dispenser 11 which is operative to dispense liquid soap, water, and hand-drying hot air automatically through the use of photodiodes which are activated by introducing the hands into a specially provided compartment on the inside wall of the inner shell 5.

On the inside wall of the inner shell there are arranged peripherally, plural flushing liquid dispensing nozzles, not shown in the figure, which form a liquid layer over the lower portion of the wall with a laminar flow of same.

In the compartment defined by the inner shell there is a bowl seat 12 made of ceramics and having a particular shape to ensure the utmost comfort for the user and least surface area in contact therewith; inside the bowl seat, moreover, there are oriented nozzles adapted to dispense water at differentiated pressure, indicated at 13 and 14, which can continuously wet the inner walls of the bowl with a thin curtain of water to prevent any matter sticking thereto.

The bowl cleaning is accomplished by means of flushing members, generally indicated at 15, which in their inoperative position are housed within the space 7 and comprise a flushing hood, generally indicated at 16, being so configured as to overlap the bowl 12 and which has on its face confronting said bowl seat a fan 17 provided on its end portions respectively with a first opening 18 so directed as to deliver the flushing liquid over the bowl surfaces, affected by the user, in an angled direction to the fan plane of rotation, and a second opening 19 adapted to deliver said liquid in a substantially orthogonal direction to the cited plane of rotation at a pressure of about 7 atmospheres.

The fan 17 is driven rotatively about its hinge axis on the hood by a drive motor of a known type, indicated at 20, which is suitably located on the remote face from that having the fan 17.

The motion transmission from the motor 20 to the fan 17 is transmitted through a toothed belt 26, respectively associated with a pulley 21 rigidly associated with the output shaft of the motor 20, and with a second pulley 22 having a larger diameter than the first pulley rigidly associated with the fan 17.

On the hood face carrying the motor 20, there is also provided a ventilation cowl 23 for delivering heated air at a temperature of about 30° internally of the fan 17 after the latter has delivered the mixture of water and disinfectant over the bowl.

In order to allow the hood 16 to swing through an opening 24 in the inner wall of the inner shell, from the space 7 internally of the latter and vice versa, there are provided on the hood 16 control members generally indicated at 25 which comprise a first connecting rod-crank lever 27 driven by a first motor 28 whereby the opening and closing is performed of a tiltable door 29 hinged at one portion thereof on the top edge of the opening 24, and a second connecting rod-crank lever 30, also driven by a second motor 32, adapted to drive and thus oscillate the hood 16, hinged on the bottom edge of the opening 24, against or by the action of elastic means, and more precisely of a spring 33, through the opening 24 from an inoperative position substantially parallel to the inner wall of the inner shell to an operative position substantially orthogonal to said wall.

Figure 4:
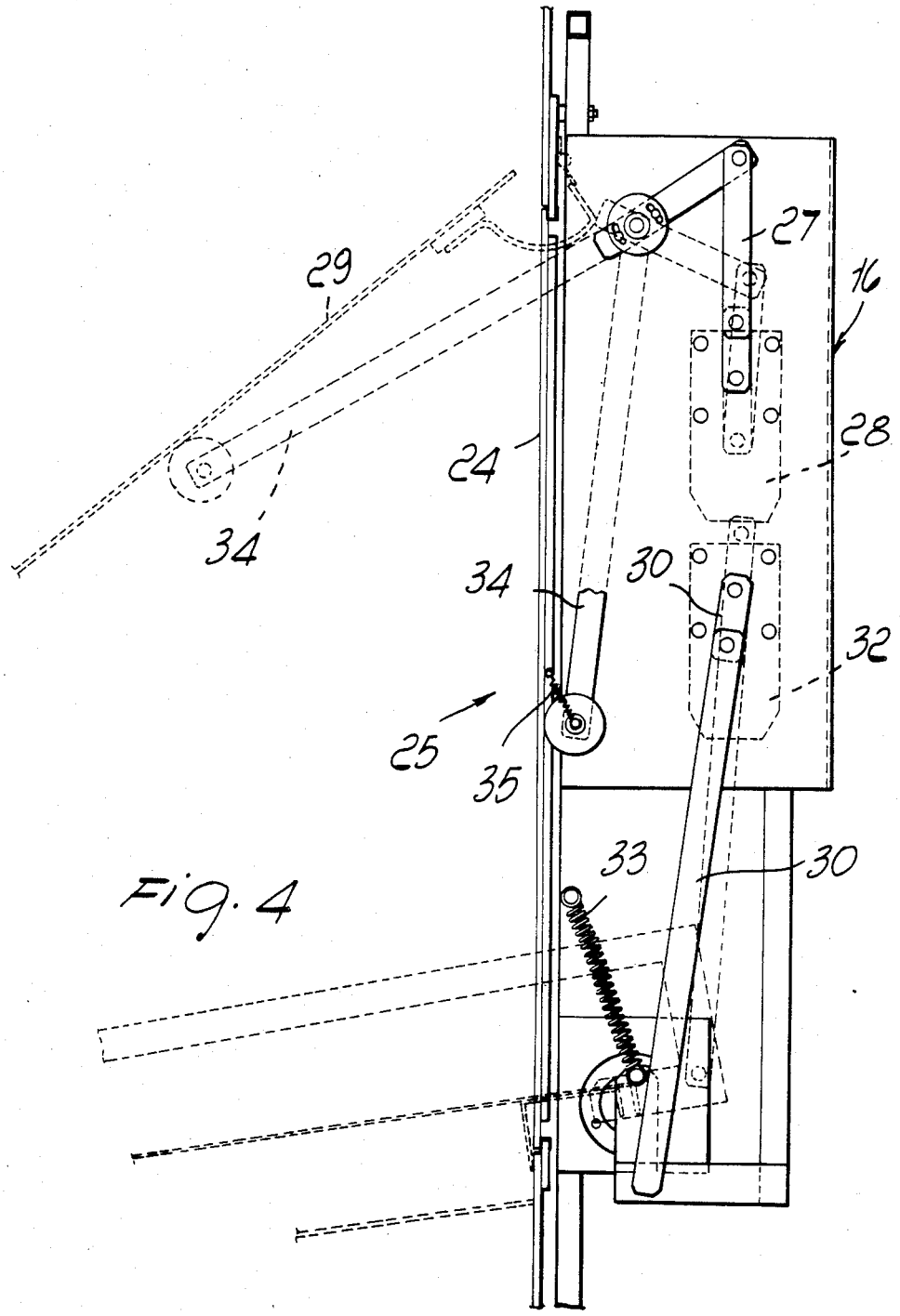
FIG. 4 is a side elevation view showing the control members for the hood in FIG. 3, according to the invention.
Figure 5:
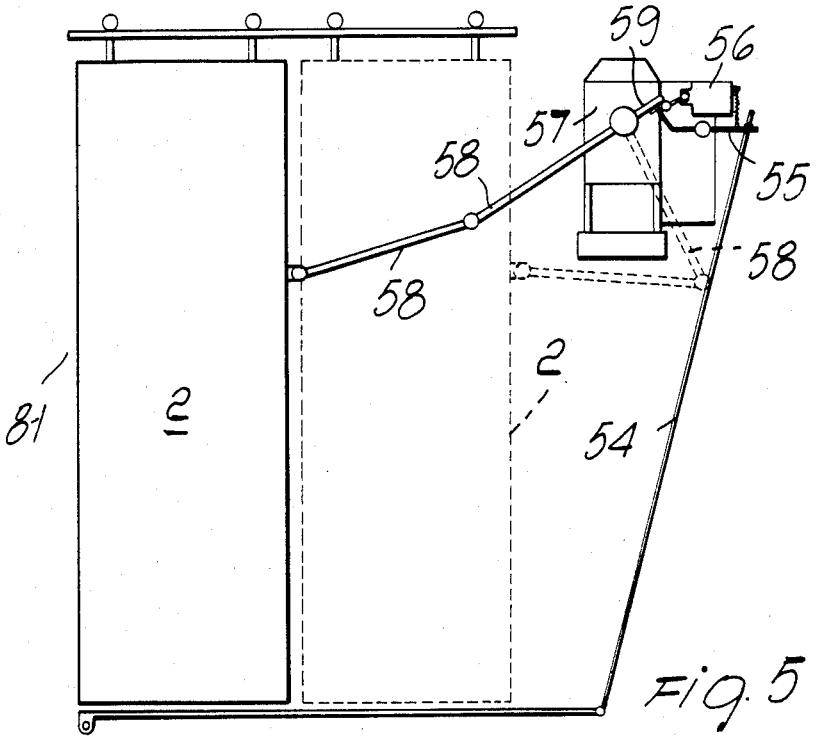
FIG. 5 shows diagramatically the cabin door actuating members, according to the invention.
Figure 6:
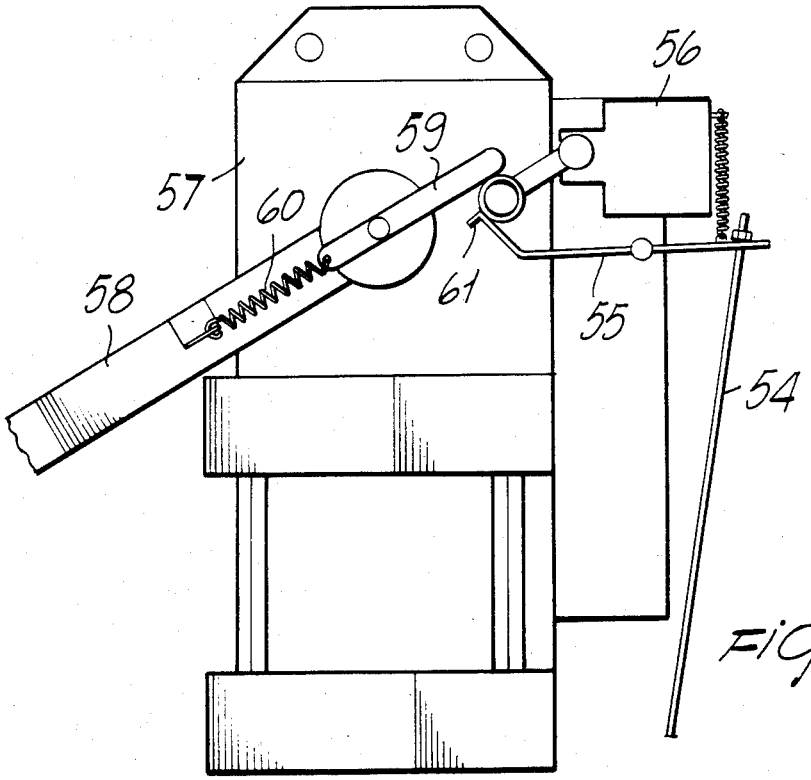
FIGS. 6 to 9 show diagramatically how the actuating members for the door shown in FIG. 5 operate according to the invention.

As shown clearly in FIG. 4 there are shown in phantom lines the different positions to be assumed by the first and second connecting rods-crank levers both during the door 29 opening phase and during the hood 16 oscillation phase when it is to provide flushing for the underlying bowl.

Advantageously with such a drive there will be two main positions available. The first of door opening defined by a rotation through about 180° of the drive shaft and the second, successive to the first, of the hood descent over the bowl also determined by a rotation of about 180° of the shaft of the second motor, on completion of the bowl flushing the first and second motors will both turn in succession through another 180° in the clockwise direction to return the first and second connecting rods-crank levers back to their initial positions thus causing initially the hood to move back to the parallel position to the inner wall of the inner shell and then the door 29 to close, For the purpose of clarification,it should be further specified that the first connecting rod-crank lever comprises a crank rod 34 having an end rigid with the connecting rod-crank lever 27 and the opposite end associated with the door through an elastic element and more precisely a spring 35 serving the function of preventing, when the door 29 is closed, it being opened for example by vandals, attemting to tamper with the mechanism.

To permit of a displacement in a substantially coaxial direction with respect to the inner shell of the tilting footrest, subjected to the weight of a user, the latter comprises a first pair of levers 36 having their ends respectively hinged both on the bed 6, for supporting the inner and outer shells, and on a second pair of levers 37, also hinged on the bed 6 so as to be aligned with the first lever pair 36.

The first and second lever pairs 36 and 37 share at their hinge points a tubular rod 38, with an orthogonal axis, from the end portions whereof there extend two arms 39 and 40 having their free ends joined and associated, as explained hereinafter, with the sensing members 9.

Advantageously the mechanism just described enables the footrest to perform a calibrated movement toward the bed 6 regardless of the point where the user will be resting thereon.

For safety reasons, to only allow the apparatus to be used by one person and inhibit its use by a child, for example, the members for sensing the weight of a person would only activate the apparatus if the weight of the user present on the footrest exceeds a minimum set weight or is lower than a maximum set weight.

The above is feasible because the sensing members 9 include first and second counterweights, both mounted oscillably about a hinge points thereof respectively indicated at 41 and 42, thereby the first counterweight 43 is adapted to counterbalance the weight of the footrest 8 in its unloaded condition and to cooperate with the second counterweight 44, only after completing a small free oscillation about the hinge point 41, so as to counterbalance in combination the overall weight of the footrest combined with the weight of the user overlying it.

More precisely, the first counterweight 43 is driven by a rod 45 which has one end hinged on the joined ends of the two arms 39 and 40, and the opposite end slidable, over some distance freely and over some distance against and by the action of a shock absorber 46, inside a cylindrical body 47 rigidly associated with either the inner or outer sheel within the space.

The bar or rod 45 has at a portion thereof a bracket 48 adapted to activate, during the axial displacement of the rod 45, first and second switches, respectively indicated at 49 and 50, adapted to inhibit the apparatus functions, when activated by the bracket 48.

For clarification, it should be further pointed out that the footrest 8 moving down under the user's weight, performs through the two arms 39 and 40 the axial displacement of the rod 45 bringing about the free oscillation of the first counterweight 43 until its support arm 51 engages with a spacer element 52, advantageously slidable on the support arm 53 of the second counterweight 44 to vary the amplitude of said free oscillation, and hence counterbalance in combination with the second counterweight the lowering of the rod 45, which after performing a sliding movement equivalent to the free oscillation of the first counterweight 43 internally of the cylindrical body 47, will perform compression of the shock absorber 46 adapted to counterbalance, together with said first and second counterweights, the user's weight up to a set maximum weight on exceeding which the bracket 48 activates the switch 50 shutting the apparatus off.

From the point of hinge connection of the rod 45 to the joined ends of the two arms 39 and 40 there extends a lay rod 54 the free end whereof is connected to an equalizer rocker arm 55 hinged on a support box for a travel limiter 56 to perform displacement of the latter and warn of the presence of a person in the apparatus.

The travel limiter 56 is rigid with a frame 57, rigidly associated with the inner shell, adapted to carry a gear motor, not shown in the figure and of a known type, driving a swivel arm 58 whose end is connected to the door to enable the booth to be opened and closed.

The swivel arm has a small rod 59 which is associated pivotally, against and by the action of an elastic member and more precisely of a spring 60, with the same point where the swivel arm is connected to the gear motor.

Figure 7:
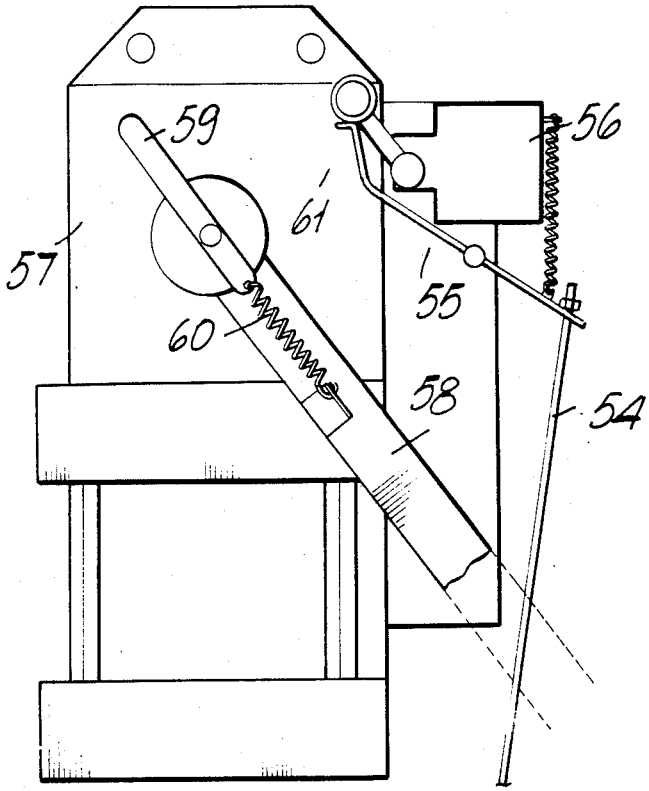
Figure 8:
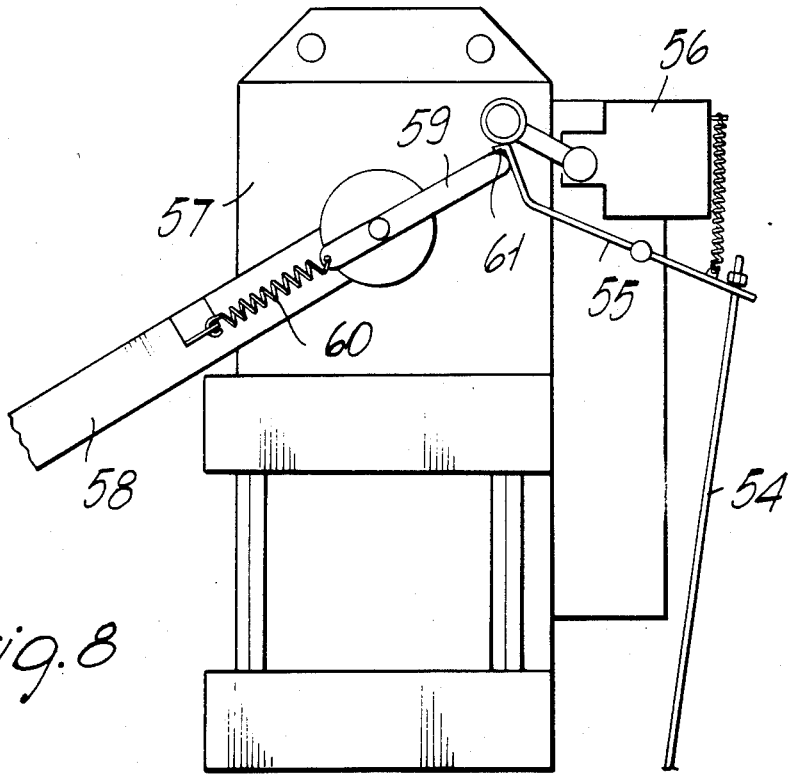
Figure 9:
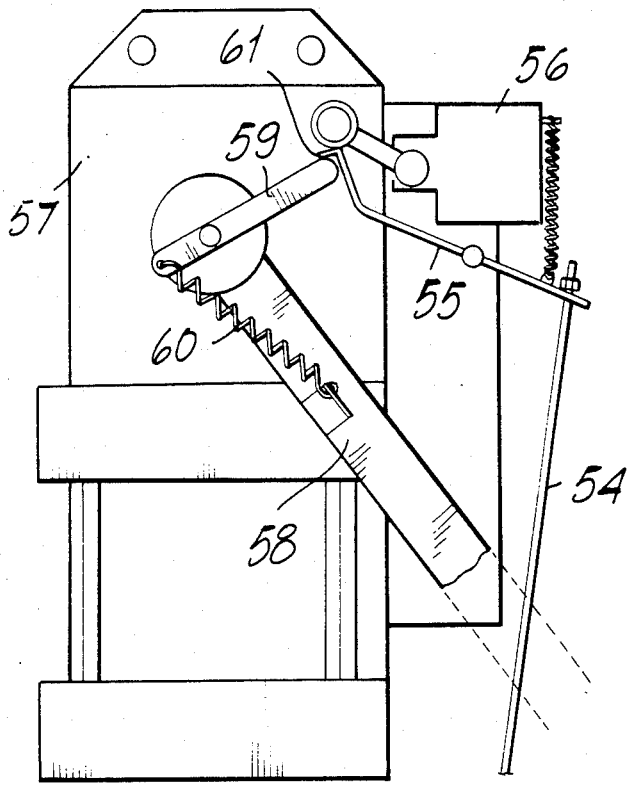
Figure 10:
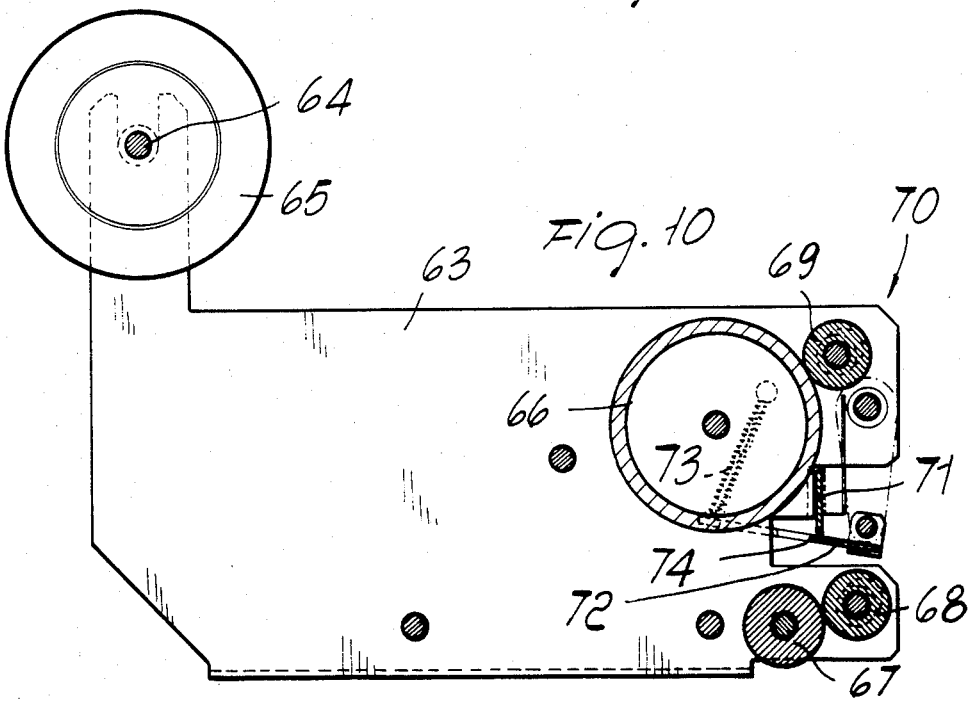
FIG. 10 is a side elevation view of the automatic toilet paper dispenser according to the invention.
Figure 11:
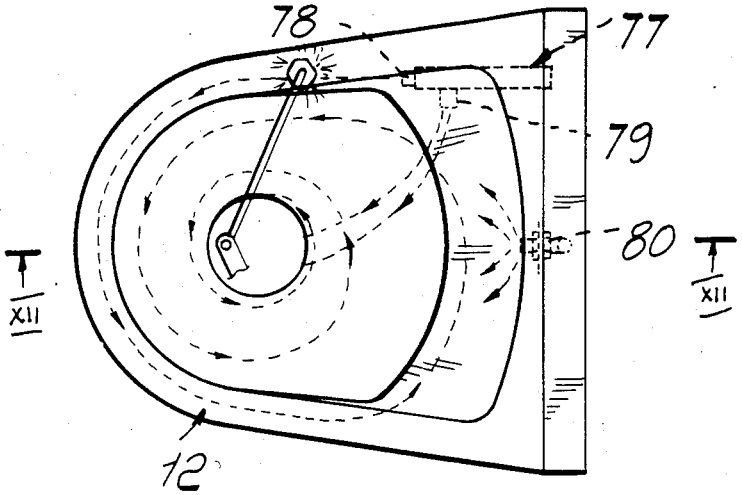
FIGS. 11 and 12 are a plan view and a sectional side elevation view of the bowl according to the invention.
Figure 12:
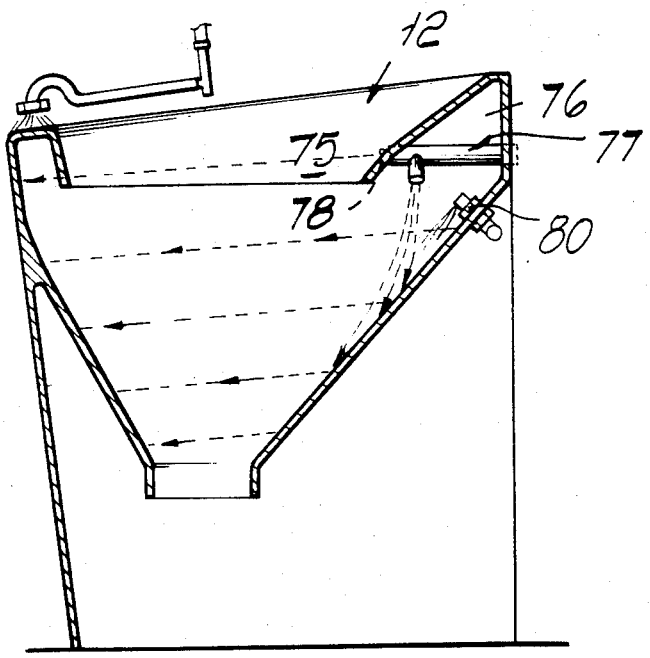
Figure 13:
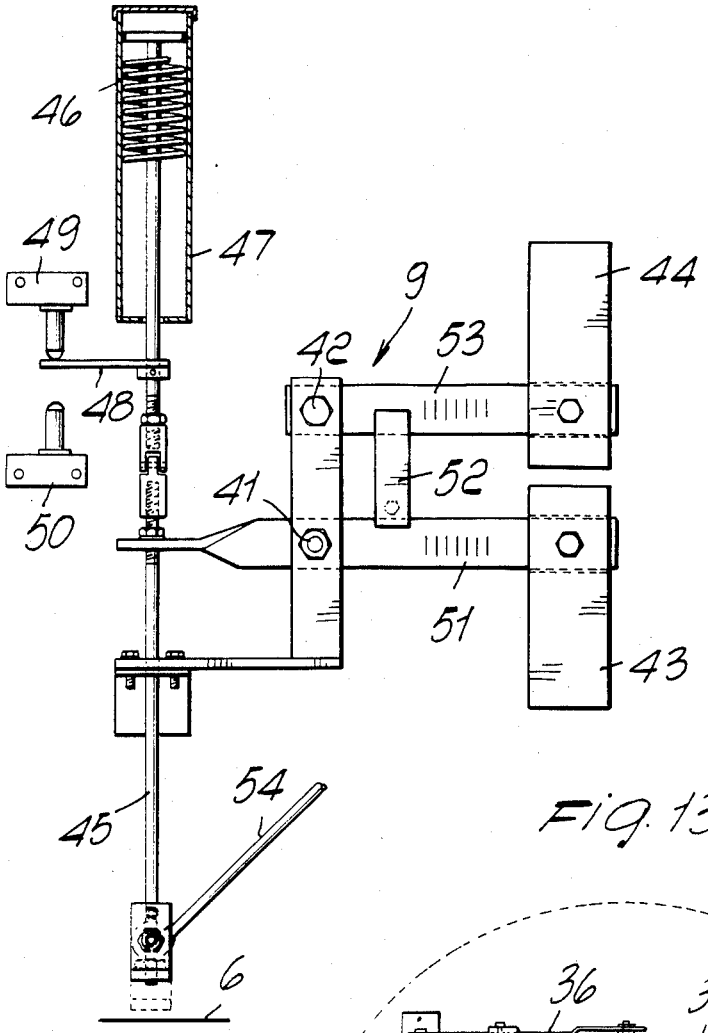
FIG. 13 is a side elevation view showing diagramatically the means of sensing the presence of a person on the footrest according to the invention.
Figure 14:
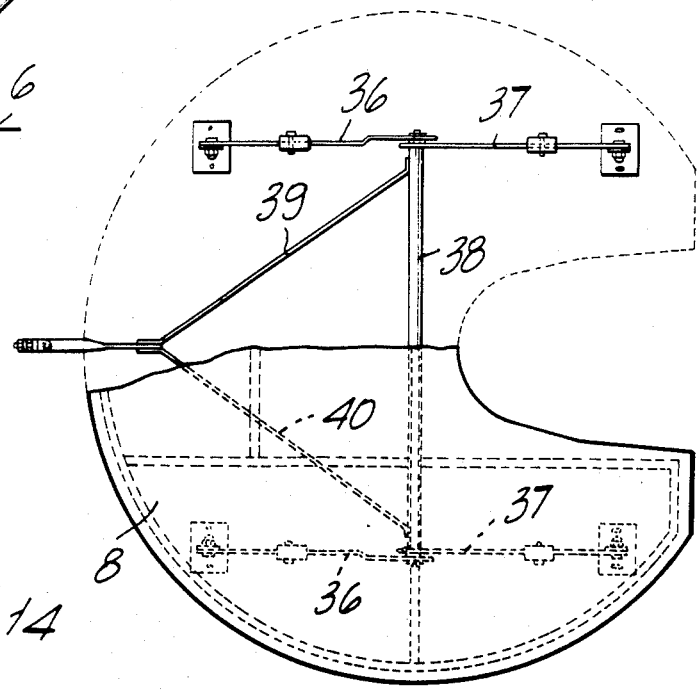
FIG. 14 is a plan view of the tilting footrest of this invention.

As is clearly shown in FIGS. 6 to 9, the door actuating members have the following succession of phases: when the booth is unoccupied with the door shut, the swivel arm is positioned as in FIG. 7 and the small rod 59 is at a position above the travel limiter 56, subsequently upon the door being opened, to admit the user into the booth, there will occur rotation of the swivel arm, and on the user bearing on the tilting footrest, lowering of the lay rod with consequent oscillation of the equalizer rocker arm 55 which will return the travel limiter 56 to an upper position.

During a following step, as shown in FIG. 8, the door closes again and the small rod 59 will position itself downwardly of the travel limiter 56 and the equalizer rocker arm 55, thereby advantageously in the event of the user sitting on the bowl seat feeling unwell and accordingly bearing no more with his/her weight on the footrest, after the door has been reopened after a set time period, by virtue of the presence of the equalier rocker arm 55 of a dog 61 this will not move back to the initial position failing to trigger the apparatus devices for internal flushing because the small rod 59 will hold it locked by engaging with the dog 61.

Inside the inner shell the user, after satisfying his/her physiological urge, can make use of an amount of toilet paper, depending on requirements, by virtue of the provision of an automatic dispenser of toilet paper, generally indicated at 62, which will dispense a programmed amount of sheet paper whose quantity is conditioned by a programmable piece in order to avoid wasteful use. The automatic toilet paper dispenser, additionally to being provided with paper presence checking facilities, and inhibiting the apparatus from use should it be exhausted, includes a frame defined by two spaced apart parallel shoulders 63 supporting rotatably thereon a support shaft 64 for a roll of toilet paper 65.

Present between the two shoulders is a main roller 66 adapted to perform unwinding of the toilet paper roll and to feed a secondary roller 67 which addresses the unwound paper out of the dispenser 62.

Said main and secondary rollers have corresponding rotational speeds and paper hold-down rollers, indicated at 68 and 69, adapted to permit the toilet paper to advance without the latter becoming crumpled or curled up and moreover has the section included therebetween stretched and adapted to be cut into set sheets by cutting members generally indicated at 70. The cited cutting members include a fixed blade 71 and a moving blade 72 which is guided oscillably by a motor, synchronized to the rotation of the main roller 66 and secondary roller 67, to and from the paper section stretched therebetween. Furthermore, the moving blade has an elastic connection member, and more precisely a spring 73, connected to the main roller 66, which allows the same to be held back adjacent the fixed blade.

Conveniently in order not to allow the sheet of paper cut off the remainder of the paper paid off the roll to fall down, the moving blade has on its cutting portion a recess 74 adapted to break the cutting portion and leave a small bridge of connection between the cut off sheet and the remainder of the roll.

On completion of the dispensing and cutting operation, the main and secondary rollers 66 and 67 will then perform a small rotation to move out of the two shoulders 63 a flap of the cut off sheet of toilet paper facilitating gripping the latter by the user and to concurrently prevent this from tearing off the sheet before it is cut.

The bowl present internally of the inner shell has advantageously steep inner walls defining a substantially conicalinternal conformation, of the bowl seat, to ensure improved smoothness on discharge and moreover, its particular outer shape, ensures maximum comfort for a minimum of surfaces in contact with the user.

From the upper edge of the bowlseat there extends internally of the latter a journal 75 adapted to define with the inner walls a channel 76 inside which there are housed the oriented water dispensing nozzles which have a first dispenser 77 having two dispensing outlets, respectively indicated at 78 and 79, inclined at an angle with respect to each other for directing said water under pressure in a coaxial direction to the channel 76 and in a substantially parallel direction to the most soiled wall such that while the first flow of water leaving the outlet 78 has a spiralling pattern, over the bowl walls, the water leaving the outlet 79 will intersect the latter creating a whirling motion adapted to crumble matter present in the bowl, to facilitate its ejection from the latter.

Said oriented nozzles further comprising a second water dispenser 80 adapted to produce across the most soiled surface a continuous sheet of water to prevent any matter sticking thereto and thus facilitate its removal.

Solely for greater precision, it should also be said that the door has a pneumatic safety rib 81 provided with a shock wave pressure switch for rapid control to reverse running in the event that it meets with an obstruction, furthermore the door is equipped with a clutch system to permit manual opening of the same in the event of a sudden power outage.

A safety pneumatic rib also provided with a shock wave manostat to rapidly control running in reverse is also provided on the door 29.

The use and operation of the self-cleaning sanitary apparatus according to the invention is extremely simple and to be performed automatically, in fact the user is merely to introduce into the coin box a required number of coins, the coin box after adding up the coins introduced enables actuation of the booth lighting, automatic opening of the door, wait timer, occupied flag on the coin box, and by the time the cabin is occupied by the user and the footrest is engaged, the following operations are successively enabled: the booth remains lighted, the door closes automatically, the air recycle fan is started, a sheet of water wipes the bowl walls continuously, safety and monitoring systems are activated, and counting of the longest available time is started.

After use, the user depresses, to get out, a special pedal which controls immediate opening of the door which will stay open until the footrest is relieved of the weight bearing on it.

With the footrest disengaged, a sequence of commands is started and more precisely the door shutting command, the lighting lamp is turned off, the film of water in the bowl is discontinued, the safety systems are deactivated, and consent is then given to commence the flushing and disinfecting cycle of the inner shell of the booth.

At this time, the inner walls are flushed up to a height of about 1 meter, the protection door is opened, and down comes the flushing hood for the bowl which will cover the upper wall of the latter to provide for its flushing clean.

Thereafter, the bowl is dried and simultaneously, over the same time period, it is arranged for the footrest to be washed. On completion of the bowl flushing, the hood moves up and re-enters its position inside the space and there occurs closing of the door re-setting the apparatus and all of the safety arrangements it includes, ready for the next utilization.

It may be appreciated from the foregoing description that the invention achieves the objects set forth and in particular the fact is emphasized that the particular embodiment of this apparatus affords a very powerful flushing action, enough to involve all those areas which are likely to be soiled, and moreover, vandalic acts cannot be practically carried out because none of the apparatus parts are accessable from inside the inner shell and all the devices described ensure the utmost degree of safety and functionality for the user.

The invention herein is susceptible to many modifications and changes without departing from the scope of the inventive concept.

Furthermore, all the details may be replaced with technical equivalents thereof.

In practicing the invention, the materials used, so long as compatible with the specific use, and the dimension and contingent shapes, may be any ones meeting individual requirements.

We claim:

1. A self-cleaning sanitary apparatus comprising: a booth having an automatically openable arcuate door, actuator members adapted for opening said arcuate door, a tubular outer shell including a number of arcuate panels defining a tubular outer wall, a tubular inner shell at least vertically surrounded by said outer shell said tubular inner shell defining within said booth a tubular inner wall of a smaller diameter than said tubular outer shell, said inner shell being positioned off-center with respect to said outer shell to define a space, between said inner and outer shells, having a region of maximum breadth and a region of minimum breadth, a bowl seat housed within said inner shell, a tilting footrest defining the floor of said inner shell and having a center portion of larger height than its peripheral portion, members for sensing a person in said inner shell and connected to said tilting footrest and to said actuating members for said door, an automatic toilet paper dispenser housed in said space for dispensing a metered amount of said toilet paper inside said inner shell, a hand washing compartment housed in said space and including an automatic soap dispenser, a plurality of washing liquid dispensing nozzles arranged peripherally around said inner wall to form a layer of said liquid exhibiting laminar flow over the lower portion of said inner wall, directed nozzles dispensing water at differentiated pressures and housed in said bowl seat, members for flushing said bowl seat housed in said space and comprising a flushing hood said flushing hood having a hood face and defining such a conformation as to overlap said bowl seat, a fan defining a rotation plane and having end portions, said fan being associated rotatably with said hood face confronting said bowl seat, said fan having in said end portions respectively a first opening for dispensing said liquid over said bowl seat surfaces affected by a user along an angled direction to said rotation plane of said fan and a second opening for dispensing said liquid along an orthogonal direction to said rotation plane, a motor having a motor side and being adapted for driving said fan, a cogged belt for transmitting the motion from a first pulley fast with said motor to a second pulley fast with said fan, said second pulley having a larger diameter than said first pulley, a ventilation cowl associated with said hood on said motor side thereof next to said first and second pulleys and remote from said fan, hood control members for swinging said hood through an opening in said inner wall from said space inwardly of said inner shell and vice versa.

2. An apparatus according to claim 1, wherein said control members comprise a first conneting rod-crank lever driven by a first motor to actuate a tilting door hinged on the top edge of said opening in said inner wall, a second connecting rod-crank lever driven by a second motor for swinging said hood against and by the action of an elastic means through said opening from a substantially parallel position to said inner wall to a substantially orthogonal position thereto, said hood being hinged to the bottom edge of said opening.

3. An apparatus according to claim 2, wherein said first connecting rod-crank lever comprises a crank lever having one end rigid with said connecting rod and the opposite end associated with said tilting door through an elastic element.

4. An apparatus according to claim 1, wherein said tilting footrest comprises at least one first pair of levers having their ends hinged respectively on a bed of said inner shell and to a second lever pair, said second lever pair being hinged on said bed in alignment with said first lever pair, said first and second lever pairs supporting said tilting footrest on the remote ends from said bed.

5. An apparatus according to claim 4, wherein said first and second lever pairs have on their common hinge point a tubular rod orthogonal thereto from the end portions whereof there extend two arms having their free ends joined and associated with said sensing members, said arms and said tubular rod being movable in an orthogonal direction to said bed.

6. An apparatus according to claim 1, wherein said sensing members comprise first and second swinging counterweights, said first counterweight being adapted to counterbalance the weight of said footrest and to cooperate with said second counterweight solely after a free oscillation of said first counterweight proportional to a downward movement of said footrest when loaded with a set weight.

7. An apparatus according to claim 6, wherein said first counterweight is actuated by a bar having one end hinged to the ends of said arms and the opposed end slidable over a distance freely and over a distance against and by the action of a shock absorber in a cylindrical body, said bar having on a portion thereof a bracket adapted to activate and deactivate first and second switches respectively of insufficient and excessive weight applied to said footrest.

8. An apparatus according to claim 6, wherein said free oscillation of said first counterweight is adjustable by shifting a spacer element slidable on said second counterweight support arms, said spacer element having a shorter length than the distance between said support arm of said second counterweight and a support arm of said first counterweight in the rest position.

9. An apparatus according to claim 1, wherein said actuating members for said door comprise: a gear motor driving a swivel arm connected with its end to said door, a small rod hinged coaxially with the hinge connection of said swivel arm with said gear motor, said small rod having one end associated with said swivel arm by means of an elastic member, a lay rod attached with one end to said ends of said arms and with the opposite end to an equalizer rocker arm driving a travel limiter for sensing the presence of said person internally of said cabin.

10. An apparatus according to claim 9, wherein said small rod is parallel to said swivel arm when said door is shut and said travel limiter activated.

11. An apparatus according to claim 9, wherein said equalizer rocker arm has a dog engaging with said small rod so as to be held back in a position activating said travel limiter when said door is open and said footrest is not subjected to the weight of said person.

12. An apparatus according to claim 1, wherein said automatic toilet paper dispenser comprises a frame defined by two parallel shoulders spaced apart and supporting rotatably a support shaft for a roll of toilet paper, a main roller of entrainment of said paper between said two shoulders and feeding a secondary roller adapted for the exiting of said paper from said dispenser, paper pinch rollers cooperating with said main and secondary rollers for advancing said paper and members for cutting said paper into set sheets.

13. An apparatus according to claim 12, wherein said cutting members comprise a fixed blade and a moving blade, said moving blade being guided swingingly by a motor in synchronization with the rotation of said main and secondary rollers to and away from said paper, there being also provided an elastic connection member for holding said moving blade slidingly adjacent said fixed blade.

14. An apparatus according to claim 13, wherein said moving blade has on its cutting portion a recess adapted to break said cutting portion, said cut off sheet being fast over an equivalent length to the width of said recess with the remainder of said toilet paper inside said shoulders.

15. An apparatus according to claim 1, wherein said bowl seat has steep inner walls defining an inside conformation of said bowl seat which is substantially conical, a journal extending partially inside said bowl seat from the top edge thereof to define a channel internally whereof there are accommodated said oriented nozzles, said oriented nozzles having a first dispenser provided with two dispensing outlets respectively inclined to address said water under pressure coaxially into said channel and in a substantially parallel direction to the one of said inner walls most affected by the filth and a second dispenser adapted to produce a continuous film of water across said wall most affected by said filth.

* * * * *